US010519705B2

(12) United States Patent
van de Wiel

(10) Patent No.: US 10,519,705 B2
(45) Date of Patent: Dec. 31, 2019

(54) INTELLIGENT SAFETY DOOR

(71) Applicant: ASSA ABLOY ENTRANCE SYSTEMS AB, Landskrona (SE)

(72) Inventor: Pieter van de Wiel, Opperdoes (NL)

(73) Assignee: ASSA ABLOY ENTRANCE SYSTEMS AB, Landskrona (SE)

( * ) Notice: Subject to any disclaimer, the term of this patent is extended or adjusted under 35 U.S.C. 154(b) by 57 days.

(21) Appl. No.: 15/752,829

(22) PCT Filed: Sep. 5, 2016

(86) PCT No.: PCT/EP2016/070845
§ 371 (c)(1),
(2) Date: Feb. 14, 2018

(87) PCT Pub. No.: WO2017/045954
PCT Pub. Date: Mar. 23, 2017

(65) Prior Publication Data

US 2018/0245401 A1 Aug. 30, 2018

(30) Foreign Application Priority Data

Sep. 16, 2015 (SE) ..... 1551190

(51) Int. Cl.
*E05F 15/42* (2015.01)
*E06B 9/68* (2006.01)
(Continued)

(52) U.S. Cl.
CPC ..... *E05F 15/42* (2015.01); *E06B 9/08* (2013.01); *E06B 9/68* (2013.01); *E06B 9/88* (2013.01);
(Continued)

(58) Field of Classification Search
None
See application file for complete search history.

(56) References Cited

U.S. PATENT DOCUMENTS 5,198,974 A 3/1993 Orsat
5,384,982 A 1/1995 Galperin
(Continued)

FOREIGN PATENT DOCUMENTS

DE 102008044990 3/2010
EP 1243943 9/2002
(Continued)

OTHER PUBLICATIONS

International Search Report and Written Opinion dated Dec. 8, 2016 in International Application PCT/EP2016/070845.
(Continued)

*Primary Examiner* — Catherine A Kelly
(74) *Attorney, Agent, or Firm* — Wissing Miller LLP

(57) ABSTRACT

The present invention concerns a motorized door comprising an array of n detection cells distributed along the length of the leading edge, capable of detecting the presence and distance, Δx, from said detection cell of a body positioned between said detection cell and a distal transverse edge. The detection cells are coupled to a CPU which triggers different actions during the closing of the shutter, depending on the proportion, P=n1/n of the number, n1, of detection cells identifying the presence of a body at a same time located at a distance, Δx≤Δxs, wherein Δxs is a predefined safety distance. (a) if P≤Ps, wherein Ps is a predefined safety proportion, the detected body is considered as an accidental obstacle and the CPU is programmed to instantly stop the movement of the shutter; (b) if P>Ps, the CPU considers that the detected body is a distal transverse edge defining the end of the closure run, and orders to decrease the closing speed of the shutter until the leading edge contacts the distal transverse edge.

10 Claims, 8 Drawing Sheets

(a) (b)

(51) Int. Cl.
*E06B 9/88* (2006.01)
*E06B 9/08* (2006.01)

(52) U.S. Cl.
CPC ..... *E05Y 2800/21* (2013.01); *E05Y 2900/106* (2013.01); *E05Y 2900/11* (2013.01); *E06B 2009/6836* (2013.01); *E06B 2009/885* (2013.01)

(56) References Cited

U.S. PATENT DOCUMENTS

| | | | | |
|---|---|---|---|---|
| 5,964,058 | A | 10/1999 | Richardson | |
| 7,034,682 | B2 | 4/2006 | Beggs et al. | |
| 2003/0085679 | A1* | 5/2003 | Bledin | E05F 15/46 318/264 |
| 2007/0261305 | A1 | 11/2007 | Kraeutler | |
| 2010/0319256 | A1 | 12/2010 | Agam et al. | |
| 2013/0086841 | A1 | 4/2013 | Luper et al. | |
| 2017/0314319 | A1* | 11/2017 | Bostyn | H01L 33/58 |
| 2017/0315262 | A1* | 11/2017 | Collins | G01V 8/20 |
| 2018/0321758 | A1* | 11/2018 | Serban | B61D 19/026 |
| 2019/0024435 | A1* | 1/2019 | Partsch | E05F 15/73 |

FOREIGN PATENT DOCUMENTS

| | | | |
|---|---|---|---|
| FR | 2819545 | | 7/2002 |
| JP | 2007138566 | A * | 6/2007 |

OTHER PUBLICATIONS

Search Report mailed in SE Application 1551190-0 dated Apr. 6, 2016.

* cited by examiner

INTELLIGENT SAFETY DOOR

This application is a 371 of PCT/EP2016/070845, filed on Sep. 5, 2016, published on Mar. 23, 2017 under publication number WO 2017/045954, which claims priority benefits from Swedish Patent Application No. 1551190-0, filed on Sep. 16, 2015, the disclosure of which is incorporated herein by reference.

TECHNICAL FIELD

The present invention concerns motorized doors and gates comprising a shutter for closing or opening an area defined by a frame. The present invention proposes a door capable of reducing the force of any impact of the closing leading edge with a body as well as when contacting an end position of the shutter. In particular, it concerns motorized doors provided with detection cells suitable for detecting the presence of a body within the closing trajectory of a leading edge of said shutter.

BACKGROUND OF THE INVENTION

Motorized doors or gates (both terms being used herein as equivalent) comprising a shutter are commonly used to shut off openings, particularly in warehouses, supermarkets, or industrial halls. These shutters are often made up of large flexible tarpaulins the lateral edges of which comprising beads (1B) which slide in guiding rails (4) situated on each side of the opening that is to be closed. Alternatively, they can be made of rigid panels hinged to one another side by side or the shutter can be a rigid panel. Automatic doors are particularly useful when they are used to separate two spaces having different environmental conditions, such as temperature, relative humidity and the like, and more particularly to separate an indoor space from outdoor. Doors able to open and close at high speed are also known for these applications and are often referred to as "fast doors".

One issue with motorized doors, particularly with fast doors due to their high closing speeds, is impacts with obstacles accidentally located within the closing trajectory of the shutter. Besides damaging the leading edge of the shutter and also disengage the bead of the shutter lateral edges from the guiding rail, the obstacle itself can be damaged. Considering that such obstacle can be a person, the danger in case of an impact of injuring said person is quite high and must be reduced. For this reason, strict norms have been imposed on motorized doors. For example, in order to comply with the European norm EN12453, the peak force of an impact with a body must not exceed the limit of 150 N during more than 5 s, and must not exceed the limit of 400 N during more than 0.75 s.

In order to meet these severe requirements, the leading edges of motorized doors are often equipped with damping elements, such as a lip made of a resilient material, or pneumatic absorbing pistons. For most doors, in particular fast doors, which have a high kinetic energy, such damping elements reduce the impact force in case of impact, but not sufficiently to meet the requirements of EN12453. Many doors are therefore additionally or alternatively provided with detection cells.

An accidental event detection cell can comprise contact detectors as disclosed for example in US2007/0261305. Alternatively, some detection cells are based on the comparison with a reference value of parameters such as the motor torque, motor energy consumption, or shutter closing speed, such as in U.S. Pat. No. 5,198,974. Such detection cells, however, identify the occurrence of an impact only after the leading edge has contacted the obstacle, which is of limited use for a person being hit by the leading edge of a closing shutter.

Since preventing is better than repairing, many motorized doors have been developed comprising (a) contactless detection cells suitable for detecting the presence of an obstacle within the closing trajectory of a shutter before an impact occurs, and (b) a control system programmed for implementing a safety function aimed at managing the accidental presence of obstacles, in particular by stopping the door in its travel when it encounters one and moving it away from the obstacle in order to allow the removal thereof.

Various types of such contactless detection cells are known in the art, such as in U.S. Pat. No. 7,034,686 disclosing a proximity detector provided with an antenna, which triggers a command to stop and reverse the closure of the vertical door when the magnetic field created by the antenna is disturbed by a foreign object. This system has the advantage of preventing an impact, but it has the drawback of lacking precision given that the magnetic field may radiate outside the closure plane and thus cause false alarms triggered by objects situated close to the door but not underneath it. Optical, ultrasonic and radar sensors are also available which are able to detect the presence of a foreign body within the trajectory of the shutter. A person skilled in the art therefore has a selection of detection cells to choose from for detecting an accidental event.

Once an obstacle has been detected, a safety function must be triggered. In particular, such safety function almost always includes stopping the closing motion of the shutter and sometimes comprises reversing the direction of the motion to re-open the shutter. For example, U.S. Pat. Nos. 7,034,682, 6,989,767, 5,198,974 and US2007/0261305 disclose safety systems for doors in which, as soon as an accidental event is detected, the motor stops, reverses its direction of rotation in order to open the door completely and stops definitively when the door is completely open. The door can be closed once again by manual intervention.

The detection cells and control systems of the art cannot identify the nature of an obstacle and would treat any identified object as an accidental obstacle. The shutter is closed when the leading edge contacts a distal transverse edge (for vertically top-down shutters, it generally corresponds to the floor). It is clear that the detection by the detection cells of the approaching distal transverse edge should not be treated as an accidental obstacle, triggering the stopping of the shutter. At the same time, the impact force between the leading edge and the distal transverse edge shall remain moderate. There are systems able to determine the instant position of the leading edge. For example, some systems count the number of revolutions of the motor to estimate the position of the leading edge. Though very simple, this system is not very reliable, at least when the shutter is a flexible shutter rolled up around a drum, because at each revolution of the drum, the length of shutter being delivered varies as a function of the diameter of the drum. A more sophisticated system uses optical sensors counting the number of specific markers provided at regular intervals on longitudinal edges of the shutter (transverse to the leading edge) which pass in front of said optical sensors. Such systems are much more reliable than the former one, but all doors are not necessarily provided with such systems, which cannot be added easily to a standard door. Furthermore, there are situations, wherein such position detection systems cannot be used satisfactorily.

For example, it is possible that a raised deck (e.g., the platform of a lorry) be momentarily installed across the door frame to serve as an upper transfer surface for moving goods from one side to the other of the door. In this case, the raised deck shall form a new "momentary distal transverse edge," where the leading edge shall stop and contact in its closed configuration. A system determining the instant position of the leading edge will be of no use in this case because the CPU would be programmed to run the shutter in the closing direction until the original distal transverse edge, which is positioned further from the momentary distal transverse edge. The CPU would consider the raised deck detected by the detection cells as an accidental obstacle, triggering the stopping of the shutter and, possibly, the reversal of the shutter movement to re-open the shutter.

There therefore remains a need in the art for detection cells and a control system applied to motorized doors, which can distinguish between a body forming an accidental obstacle and a body forming a distal transverse edge defining the final position of the leading edge when the shutter is closed. The present invention provides a motorized door provided with detection cells and a control system (CPU), which avoids any impact of the leading edge of the shutter with a body with an impact force of more than 400 N as defined in EN12453. At the same time, the CPU is able to distinguish between an accidental obstacle and a distal transverse edge, regardless of the position of the latter, and to trigger different actions depending on the nature of the body. The detection cells and control system of the present invention can be implemented on any existing doors with little effort and low cost. This and other advantages of the present invention are presented in continuation.

SUMMARY OF THE INVENTION

The present invention is defined in the appended independent claims. Preferred embodiments are defined in the dependent claims. In particular, the present invention concerns a motorized door for closing an area, said area being defined by a first and second lateral edges which extend parallel to a longitudinal axis, X1, by a proximal transverse edge extending parallel to a transverse axis, X2, normal to the longitudinal axis, X1, and a distal transverse edge, transverse to the longitudinal axis, X1, wherein said motorized door comprises:

(A) A shutter of dimensions suitable for closing the area, and comprising a leading edge substantially parallel to the distal transverse edge of the area, (B) A motorized driving mechanism suitable for moving the leading edge of the shutter along the longitudinal axis, X1, between an open position (x1,1), wherein the leading edge is adjacent to the proximal transverse edge and a closed position (x1,0), wherein the leading edge contacts the distal transverse edge, in a first direction (α) to close said area and in a second direction (β) to open said area;

(C) An array of n detection cells (s1, s2, . . . , sn), wherein n≥2, distributed along the leading edge of the shutter, each detection cell being suitable for detecting and communicating to a processing unit (CPU) the presence and distance, Δx, from said detection cell measured along the longitudinal axis, X1, of a body positioned between said detection cell and the distal transverse edge, (D) A processing unit (CPU) programmed to receive signals from each of the n detection cells and to trigger the following operations, in case a number n1 of the n detection cells, with n1≥1, communicates to the CPU the detection of the presence of a body located at a distance, Δx, of less than or equal to a predefined safety distance, Δxs, from said detection cell, Δx<Δxs, during the moving in the first direction (α) of the shutter at a service closing speed, v1, from the open position (x1,1) towards the closed position (x1,0), (a) In case the proportion, P=n1/n, of detection cells identifying the presence of a body at a same time located at a distance, Δx≤Δxs, is less than or equal to a predefined safety proportion, Ps, (P≤Ps) the CPU is programmed to instantly stop the movement of the leading edge in the first direction (α), and optionally reverse said movement into the second direction (β);

(b) In case the proportion, P, of detection cells identifying the presence of a body at a same time located at a distance, Δx≤Δxs, is greater than the safety proportion, Ps, (P>Ps), the CPU is programmed to communicate a signal to progressively reduce the closing speed of the leading edge in the first direction (α), down to a stop upon contacting said body at Δx=0.

The safety proportion, Ps, can for example be comprised between 80% and 100%, preferably between 90% and 100%. The array of n detection cells distributed along the leading edge of the shutter may count at least 3, preferably at least 4, more preferably at least 5 detection cells per metre of leading edge measured along the transverse direction, X2. The detection cells can be selected among one or more of the following: ultrasonic sensors, optical sensors, capacitor sensors, radar sensors, or radio-frequency sensors.

The CPU can also be programmed to trigger the following actions in case P≤Ps, and all of the n1 detection cells having detected the presence of a body communicate to the CPU that said body is located at a distance, Δx, greater than the predefined safety distance, Δxs, from each of said detection cells, Δx>Δxs, during the moving in the first direction (α) of the shutter at the service closing speed, v1, from the open position (x1,1) towards the closed position (x1,0):

(a) In case the distance, Δx, is greater than a precautionary distance, Δxp, which is predefined, keep closing the door at the service closing speed, v1, (b) In case the distance, Δx, is not greater than the precautionary distance, Δxp, reducing the closing speed to a reduced closing speed, v2<v1.

The service closing speed, v1, is typically comprised between 0.25 and 1 m/s, preferably between 0.5 and 0.8 m/s. The reduced closing speed, v2, can then be comprised between 40% and 80% of v1, preferably between 50% and 75% of v1.

The distance, Δx, the leading edge of a door covers in a closing time, t, can be calculated as the product of the closing speed with closing time, Δx=v1·t. Similarly, the safety distance, Δxs, required for a given application depends inter alia on the closing speed, v1, and can be calculated as, $\Delta xs = v1 \cdot t_{imp}$, wherein $t_{imp}$ is a safety impact time required for the leading edge to cover the distance, Δxs, at the service closing speed, v1. The safety impact time, $t_{imp}$, is preferably comprised between 0.5 and 3 s, preferably, between 0.8 and 2 s.

The CPU can also be programmed to trigger the following actions after instantly stopping the movement of the leading edge in the first direction (α), in response to the detection by a proportion, P≤Ps, of detection cells of the presence of an object at a distance Δx≤Δxs:

reversing the movement of the leading edge into the second direction (β) until the leading edge reaches a waiting position, Xw, where it stops, waiting at the waiting position, Xw, for a waiting time, tw, and resuming movement of the leading edge in the first direction (α) as long as no body is detected by the detection cells.

In a preferred embodiment, the CPU is programmed to repeat the foregoing actions, after instantly stopping (N−1) times the movement of the leading edge in the first direction (α), without reaching the distal transverse edge. If the leading edge is stopped a $N^{th}$ time, the CPU is programmed to reverse said movement into the second direction (β) until the leading edge reaches the open position (x1,1). The value of N is preferably comprised between 2 and 5 times.

BRIEF DESCRIPTION OF THE FIGURES

For a fuller understanding of the nature of the present invention, reference is made to the following detailed description taken in conjunction with the accompanying drawings in which.

DETAILED DESCRIPTION OF THE INVENTION

Figure 1:
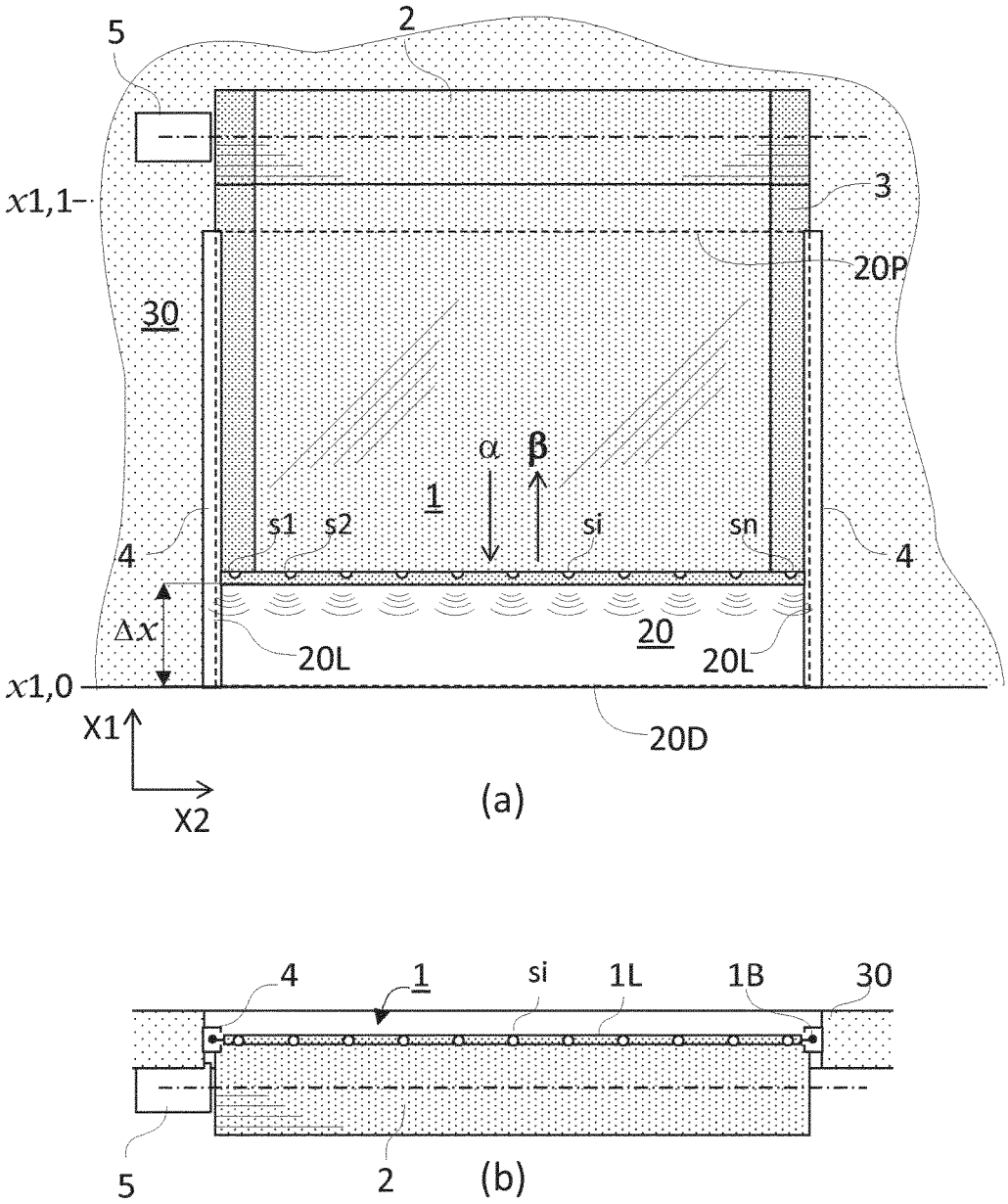
FIG. 1: shows a door according to the present invention, with (a) a front view and (b) a bottom view.
Figure 9:
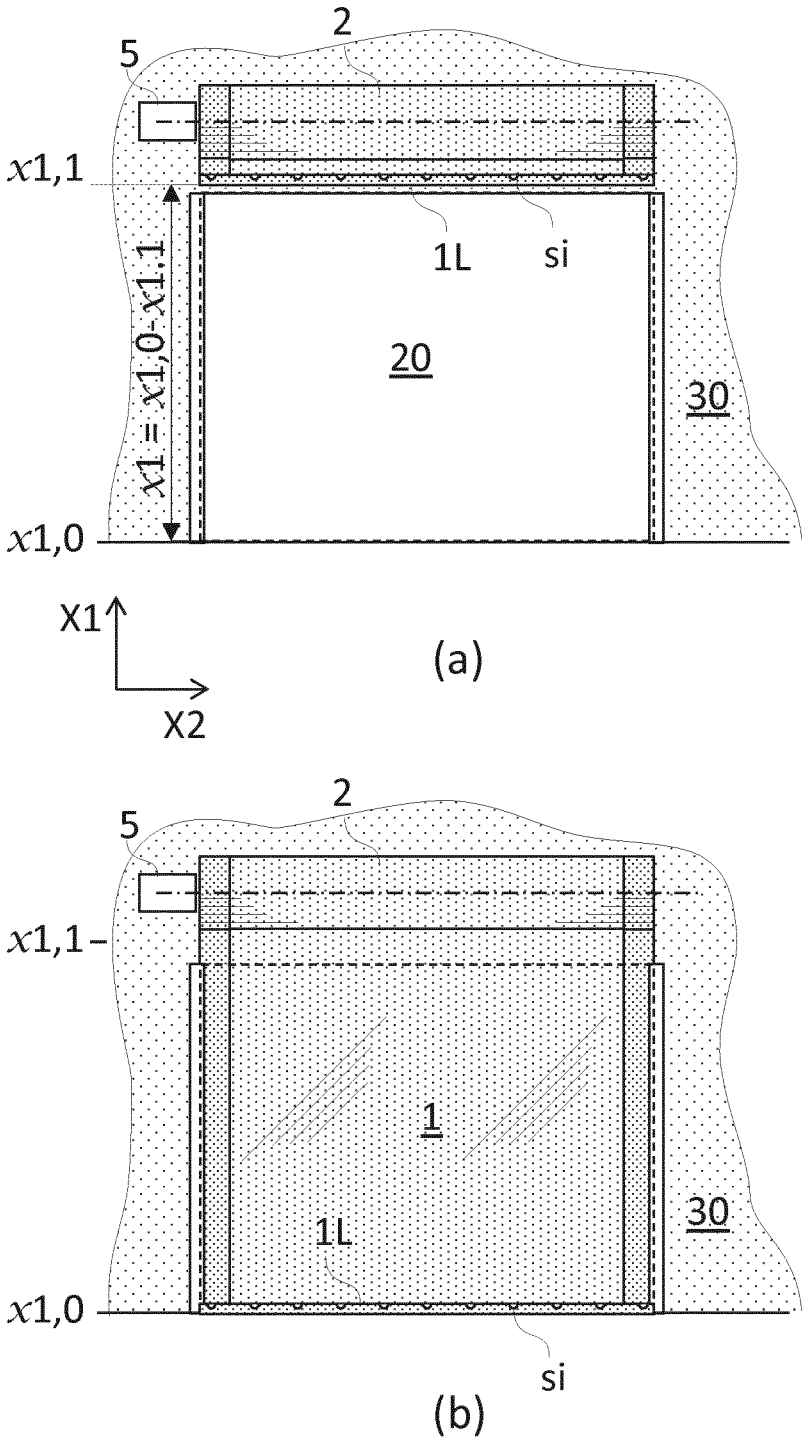
FIG. 9: shows a door according to the present invention with the shutter (a) open, and (b) closed.

As illustrated in FIG. 1, a motorized door according to the present invention is for closing a quadrilateral area (20) defined by a first and second lateral edges (20L) which extend parallel to a longitudinal axis, X1, by a proximal transverse edge (20P) extending parallel to a transverse axis, X2, normal to the longitudinal axis, X1, and a distal transverse edge (20D), transverse to the longitudinal axis, X1. In most cases the distal transverse edge is parallel to the proximal transverse edge and to the transverse axis, X2, but this is not necessarily the case. The area comprises an opening to be closed with a shutter (1) of dimensions suitable for closing the area and the opening comprised therein. The shutter comprises a leading edge (1L) substantially parallel to the distal transverse edge (20D) of the area. The motorized door comprises a motorized driving mechanism (5) suitable for moving the leading edge (1L) of the shutter along the longitudinal axis, X1, over a distance x1=x1,0−x1,1, between an open position (x1,1), wherein the leading edge is adjacent to the proximal transverse edge (cf. FIG. 9(*a*)) and a closed position (x1,0), wherein the leading edge contacts the distal transverse edge (cf. FIG. 9(*b*)). The leading edge can move in a first direction (α) to close said area and in a second direction (β) to open said area (cf. arrows α&β in FIGS. 1&2).

Figure 2:
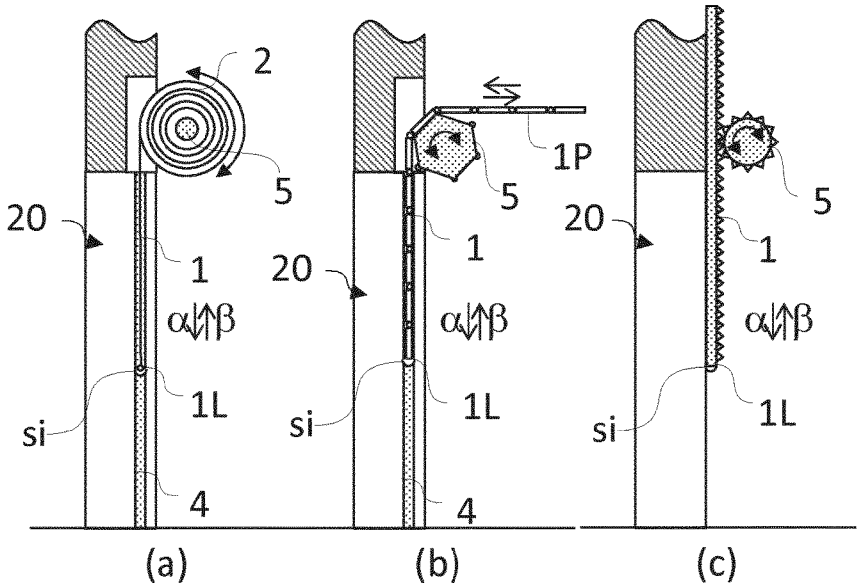
FIG. 2: shows three embodiments of motorized doors according to the present invention.

As shown in FIG. 2(*a*) the shutter can be a flexible shutter in the form of a flexible fabric or curtain, and the motorized driving mechanism (5) drives the rotation of a drum (2) to move the leading edge (1L) in the first direction (α) to close the area by unwinding the flexible shutter from said drum, and to move it in the second direction (β) to open said area by winding the flexible shutter about said drum.

FIG. 2(*b*) illustrates a deformable shutter comprising rigid panels (1P) hinged to one another parallel to the transverse axis, X2, wherein the motorized driving mechanism (5) drives the rotation of an axle about which the hinged panels rotate and change direction. For example, radial pins or teeth in the axle may cooperate with openings within the hinges between panels to ensure a slip-free movement of the deformable shutter. Alternatively, cables or chains can be used to drive the movement of the shutter.

FIG. 2(*c*) shows a third type of shutter in the form of a rigid shutter, wherein the motorized driving mechanism (5) drives the rotation of an axle which moves the rigid shutter in the plane of said area in the first and second directions α&β. A gear system is illustrated in FIG. 2(*c*), but any means known to a person skilled in the art for moving up and down a rigid shutter, such as cables or chains can be used without affecting the present invention.

Figure 10:
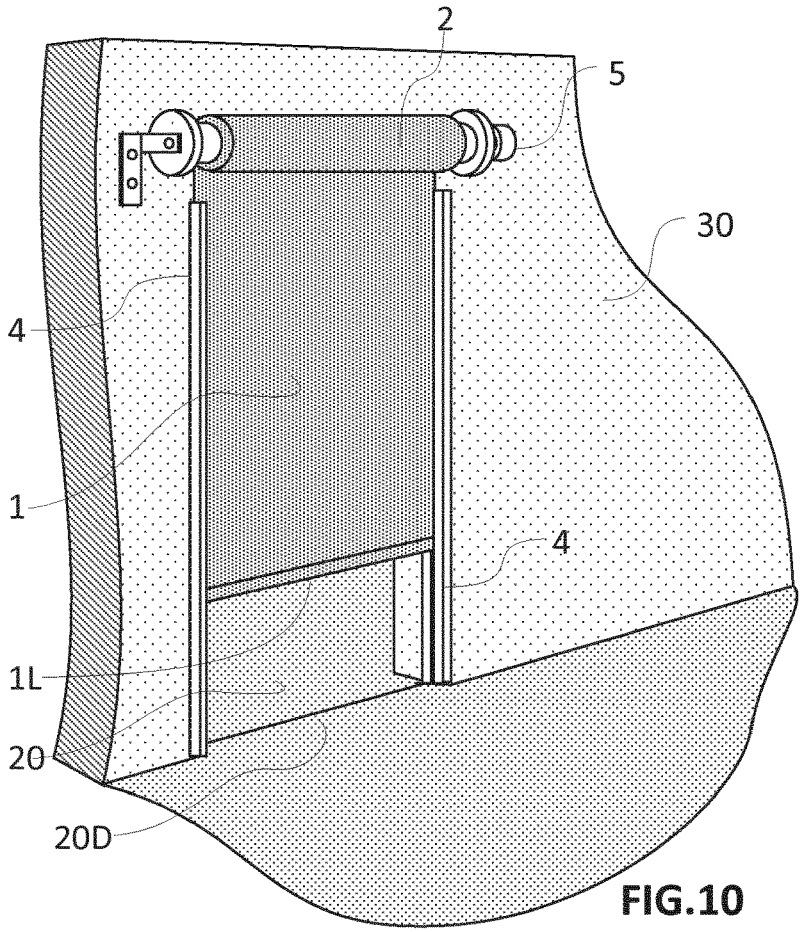
FIG. 10: shows a perspective view of a door according to the present invention.

In case of a vertical area (20) as illustrated in FIGS. 1&10, a shutter is a surface defined by a leading edge (1L) moving up (β) and down (α), said leading edge bridging two lateral edges parallel to one another. Regardless of the type of shutter used, the lateral edges are preferably engaged in guiding rails (47) suitable for guiding the shutter in its trajectory when opening or closing the area (20). An example of an automatic door comprising lateral edges of a shutter coupled to guiding rails is given e.g., in EP0587586 or WO2008155292, the contents of which are herein incorporated by reference.

A motorized door according to the present invention must also comprise an array of n detection cells (s1, s2, . . . , sn), wherein n≥2, distributed along the leading edge of the shutter. Each detection cell is suitable for detecting and communicating to a processing unit (CPU) the presence and distance, Δx, from said detection cell measured along the longitudinal axis, X1, of a body positioned between said detection cell and the distal transverse edge.

The gist of the present invention is the control system, driven by a processing unit (CPU) which is programmed to receive signals from each of the n detection cells, either continuously, or at regular intervals. Energy can be saved by activating the detection cells only when the leading edge is moving in the closing direction, a. For high speed doors, a continuous communication between detection cells and CPU is preferred or, in case of intermittent communication, the frequency of emitted signals should be high, preferably greater than 1 signal per second. When, during the moving in the first direction (α) of the shutter at a service closing speed, v1, from the open position (x1,1) towards the closed position (x1,0), a number n1 of the n detection cells, with n1≥1, communicates to the CPU the detection of the presence of a body located at a distance, Δx, of not more than a predefined safety distance, Δxs, from said detection cell, Δx<Δxs, the CPU is programmed to trigger the following operations depending on the proportion, P=n1/n, of detection cells having detected a body.

In case the proportion, P=n1/n, of detection cells identifying the presence of a body at a same time is not more than a predefined safety proportion, Ps, (P≤Ps) the CPU is programmed to instantly stop the movement of the leading edge in the first direction (α). The CPU may optionally be programmed to then reverse said movement into the second direction (β) to drive the leading edge away from the identified body. This optional reversal of the shutter movement depends inter alia on the value of the safety distance, Δxs: for high values of Δxs, a reversal may not be necessary; for short safety distances, Δxs, a reversal may be advisable.

Figure 12:
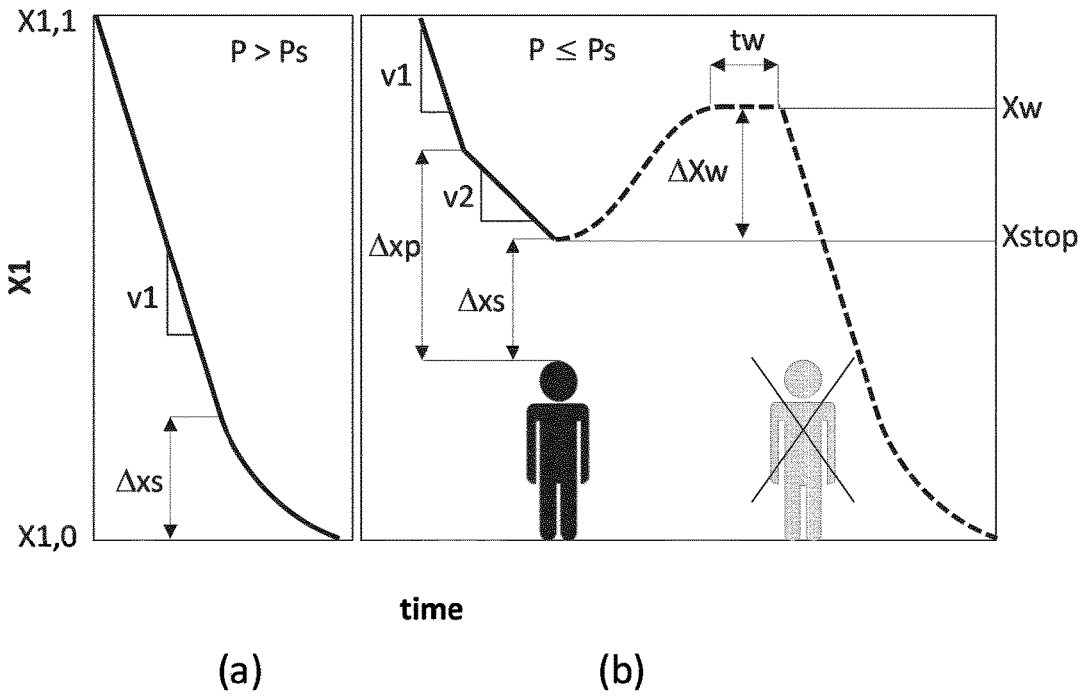
FIG. 12: the time dependent movement of the shutter of a door according to the present invention in case (a) no accidental obstacle is identified (P>Ps) and (b) in case an accidental obstacle (a person) is identified, according to a preferred embodiment.

In case, however, the proportion, P=n1/n, of detection cells identifying the presence of a body at a same time is greater than the safety proportion, Ps, (P>Ps), the CPU is programmed to communicate a signal to progressively reduce the closing speed of the leading edge in the first direction (α), down to a stop upon contacting said body at Δx=0 of the detection cell located closest to said body (cf. FIG. 12(*a*)).

Figure 4:
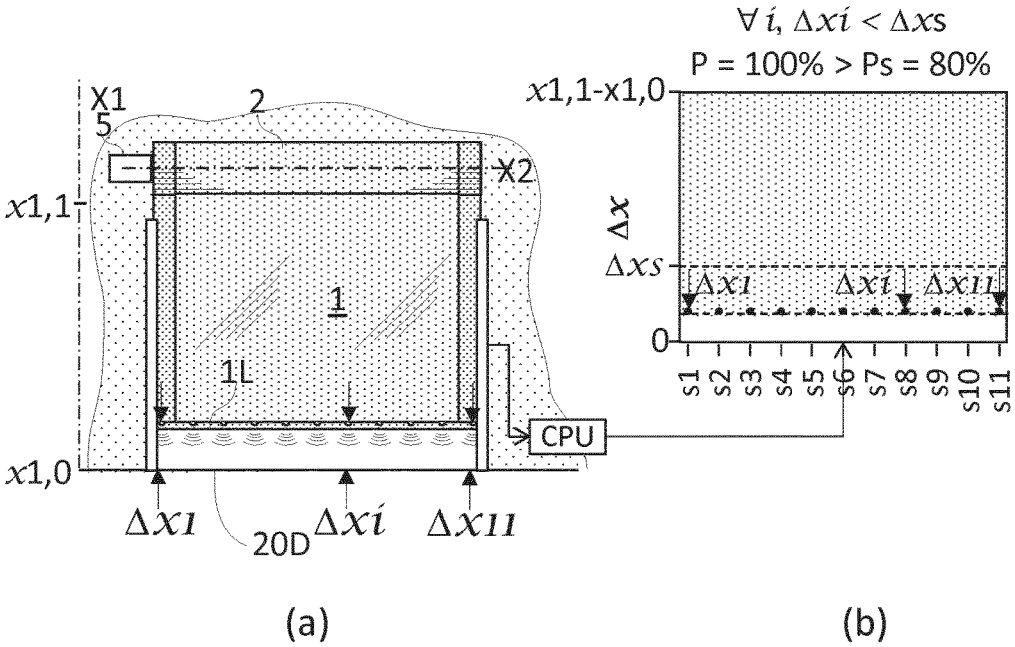
FIG. 4: shows (a) a door according to the present invention, wherein the leading edge approaches the floor forming the distal transverse end, and (b) the information received by the CPU from the various detection cells indicating that all detection cells identified a body at a distance <Δxs, construed by the CPU as being the distal transverse end.
Figure 5:
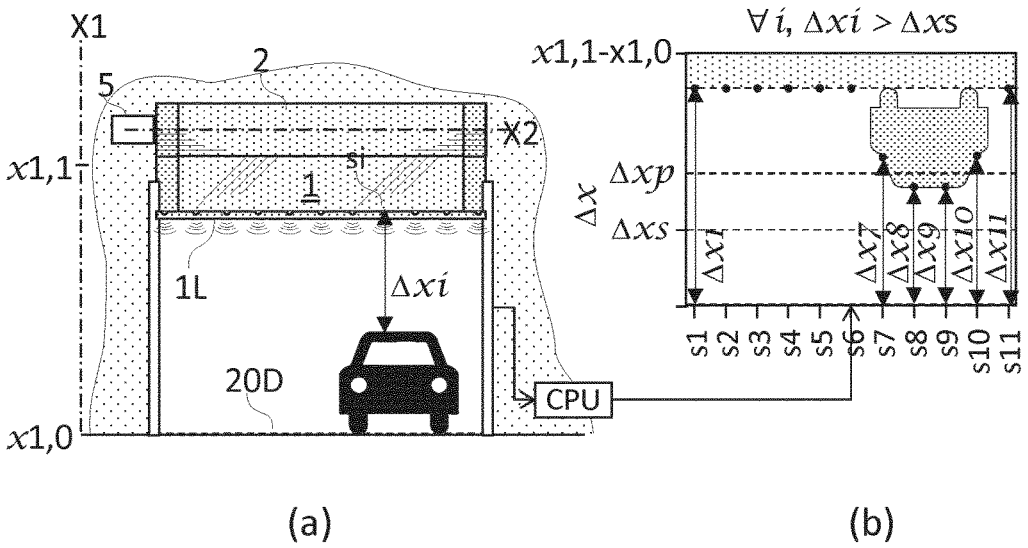
FIG. 5: shows (a) a door according to the present invention, wherein the leading edge approaches the floor forming the distal transverse end with a car parked underneath, and (b) the information received by the CPU from the various detection cells indicating that a proportion, P<Ps; of the detection cells identified a body at a distance >Δxs, construed by the CPU as an accidental obstacle located at a safe distance from the leading edge.
Figure 6:
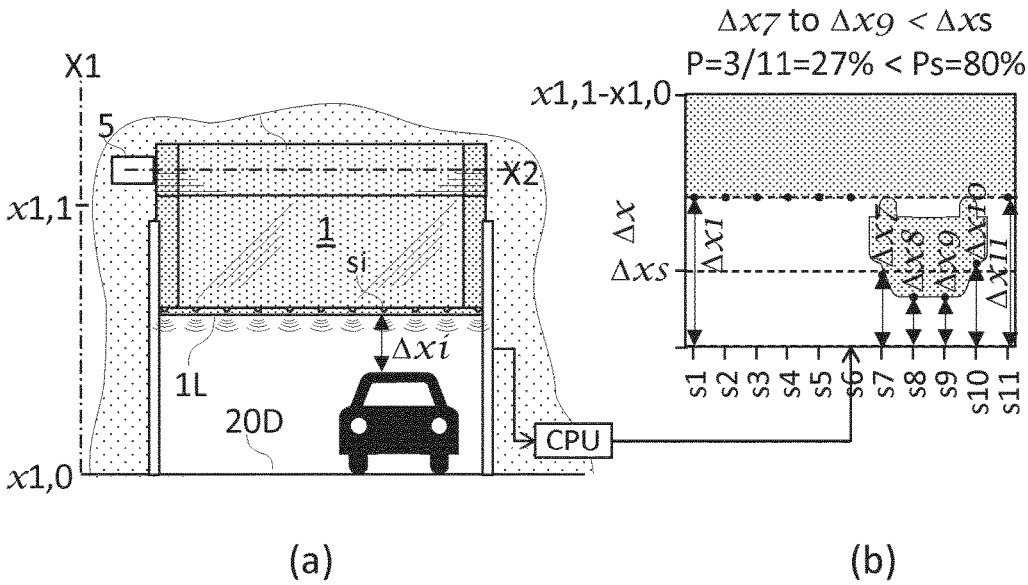
FIG. 6: shows the car still parked underneath, and (b) the information received by the CPU from the various detection cells indicating that a proportion, P<Ps; of the detection cells identified a body at a distance <Δxs, construed by the CPU as an accidental obstacle located at a short distance from the leading edge and involving a risk of impact.
Figure 7:
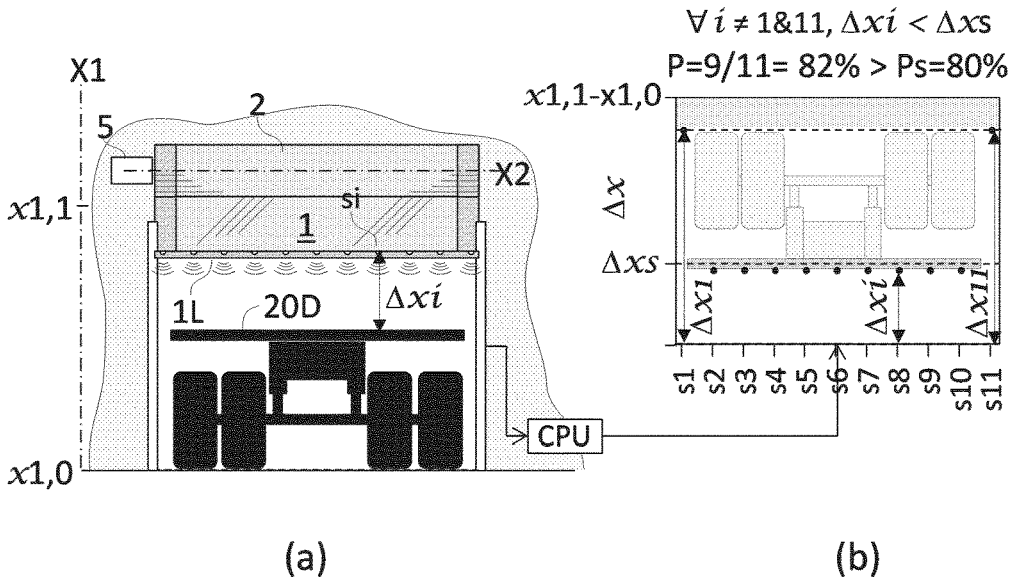
FIG. 7: shows (a) a door according to the present invention, wherein the leading edge approaches the floor forming the distal transverse end with a raised deck of a lorry parked underneath, and (b) the information received by the CPU from the various detection cells indicating that a proportion, P>Ps; of the detection cells identified a body at a distance <Δxs, construed by the CPU as being a distal transverse end.
Figure 8:
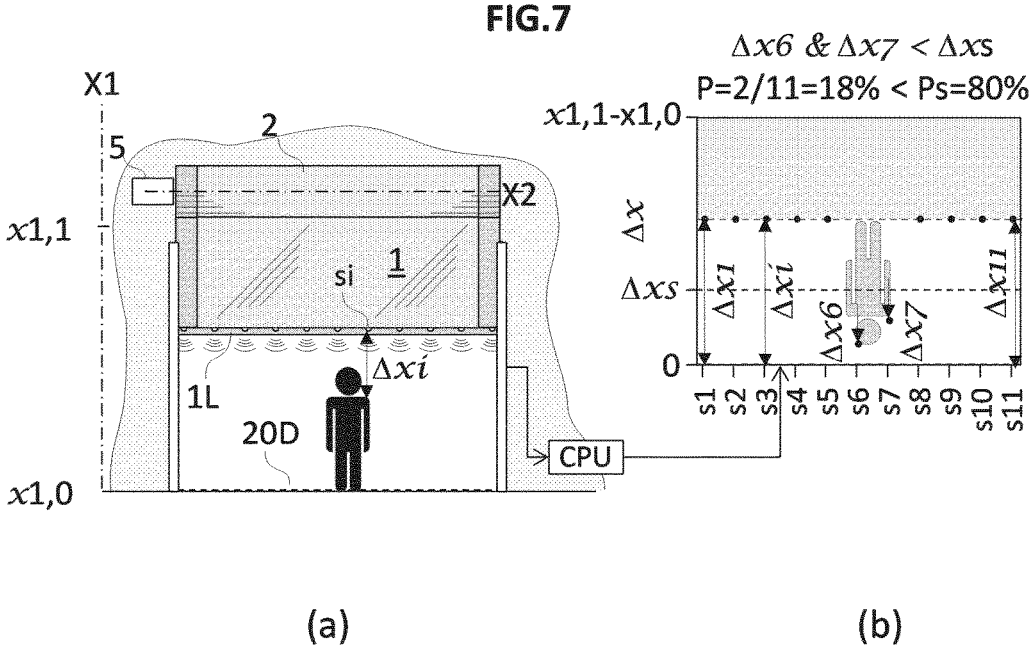
FIG. 8: shows (a) a door according to the present invention, wherein the leading edge approaches the floor forming the distal transverse end with a person standing underneath, and (b) the information received by the CPU from the various detection cells indicating that a proportion, P<Ps; of the detection cells identified a body at a distance <Δxs, construed by the CPU as an accidental obstacle located at a short distance from the leading edge and involving a risk of impact.

By considering the proportion, P=n1/n, of detection cells identifying the presence of a body at a same time, the CPU is able to "distinguish" between:

- an actual accidental body, such as a person as illustrated in FIG. 8 or an object like an automobile (as illustrated in FIGS. 5&6, which contact with the leading edge of the shutter should be avoided, and
- a distal transverse edge (20D) defining the end of the run of the shutter for closing the area (20), as illustrated in FIGS. 4&7, the latter showing a provisional raised deck formed by the platform of the trailer of a lorry.

This system is highly advantageous, because it requires no metering system capable of determining the instant position of the leading edge. Such systems can be unreliable, for example if counting the number of revolutions of a drum (2) carrying a flexible shutter wound around it, or not readily available or easy to install in existing doors, in case for example of optical sensors counting markers distributed along an edge of the shutter. Furthermore, a metering system is not capable of taking account of a provisional raised deck as illustrated in FIG. 7, which may be formed by a ramp or by the platform of a trailer parked across the plane of the area (20).

By distinguishing between accidental obstacles and distal transverse edges (even if not at a fixed position), by means of the proportion, P=n1/n, of detection cells identifying the presence of a body at a same time, and by considering the closest distance, Δx, of said body from a detection cell with respect to a safety distance, Δxs, a motorized door according to the present invention can be run with a high level of security, in accordance with the requirements of EN12453 and, at the same time smoothly closing an area, contacting the distal transverse edge (20D) at nearly zero velocity. The detection of an obstacle and its identification by the CPU allows for the use of motors of lower power, since quick starts and stops are operations driving motor size and therefore also cost (of the motor and its power consumption), and said operations can be avoided with the present invention.

The safety proportion, Ps, of detection cells identifying the presence of a body at a same time used to trigger the sudden stopping of the shutter (if P≤Ps), or the slowing down of the closing velocity of the shutter (if P>Ps) depends on the number, n, of detection cells, and their position along the leading edge of the shutter. The safety proportion, Ps, is generally comprised between 80% and 100%, preferably between 90% and 100%. If Ps=100%, a body detected by (some of) the detection cells (si) will be considered as the distal transverse edge only in case all the detection cells identify the presence of said body at a same time. In case of a vertical shutter as illustrated in FIGS. 1&4, the distal transverse edge is usually formed by the floor, which will necessarily be identified by all the detection cells together. A lower value of Ps, between 80 and less than 100% makes sense in case the position of the distal transverse edge may vary with time. It could be formed by a raised deck such as a ramp or the platform of the trailer of a lorry, as illustrated in FIG. 7. In this case, the detection cells located closest to the lateral edges (20L) of the area (20) may not identify the presence of a raised deck, and yet the stopping of the shutter may not be desirable, since the leading edge of the shutter should continue its movement until it reaches the level of the raised deck.

Although two detection cells (n=2) are theoretically sufficient to carry out the present invention, it is preferred to have a higher number of detection cells distributed along the leading edge of the shutter For example, the array of n detection cells distributed along the leading edge of the shutter preferably comprises at least 3, preferably at least 4, more preferably at least 5 detection cells per metre of leading edge measured along the transverse direction, X2. A higher number of detection cells allows a safer distinction by the CPU between an accidental obstacle and a distal transverse edge. On the other hand, a higher number of detection cells increases the cost of the door. By increasing the angle of the area covered by each detection cell, it is possible to cover the whole area below the door's leading edge. This, however, is at the expenses of a lower accuracy of the definition of the shape of an object detected within the trajectory of the leading edge. A good balance between the requirements and cost of the door must be found in each particular case, a task which is well within the skills of a person of the art.

To further increase the security of the door in case of P≤Ps (i.e., detection of a body considered by the CPU as an accidental obstacle), the CPU may also consider the case wherein all of the n1 detection cells having detected the presence of a body communicate to the CPU that said body is located at a distance, Δx, greater than the predefined safety distance, Δxs, from each of said detection cells, Δx>Δxs, during the moving in the first direction (α) of the shutter at the service closing speed, v1, from the open position (x1,1) towards the closed position (x1,0). If such situation happens, the CPU can thus be programmed to trigger the following operations:

(a) In case the distance, Δx, is greater than a precautionary distance, Δxp, keep closing the door at the service closing speed, v1, (b) In case the distance, Δx, is not greater than the precautionary distance, Δxp, reducing the closing speed to a reduced closing speed, v2<v1, as illustrated in FIG. 12(*b*). The reduced closing speed, v2, can typically be comprised between 40% and 80% of v1, preferably between 50% and 75% of v1.

Figure 3:
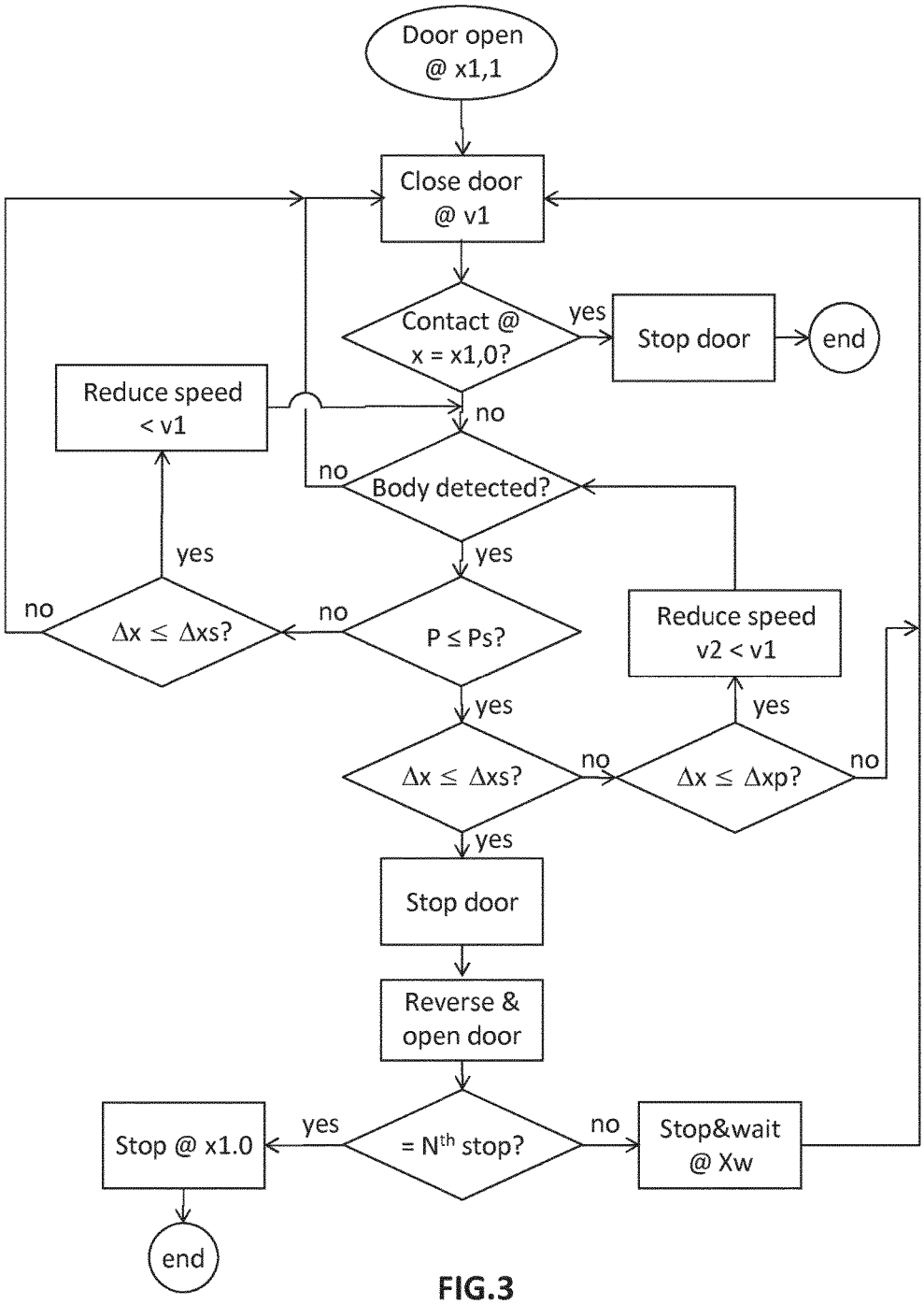
FIG. 3: shows a flow chart of the actions the CPU is programmed to trigger depending on the events according to an embodiment of the present invention.

FIG. 3 shows a flow chart illustrating various steps triggered by the CPU depending on the situation. Starting from an open door, the leading edge is moved along the longitudinal axis, X1, at a service closing speed, v1, as long as no body is detected by any detection cell (si). If a body is detected at a distance, Δx≤Δxs, the CPU considers the proportion, P=n1/n, of detection cells identifying the presence of a body at a same time. If the proportion, P, is smaller than or equal to the safety proportion, Ps, (P≤Ps) the CPU considers that the detected body is an accidental obstacle and stops the movement of the shutter. If, on the other hand, the proportion, P, is larger than the safety proportion, Ps, (P>Ps) the CPU considers that the leading edge is approaching the distal transverse end and reduces the speed of the leading edge, until it reaches the distal transverse edge at which point the leading edge is stopped, as illustrated in FIG. 12(*a*).

According to a preferred embodiment described above, in case P≤Ps, but none of the detection cells has identified an object at a distance less than Δxs, (Δx>Δxs for all of the n1 detection cells), the CPU considers a predefined precautionary distance, Δxp>Δxs, above which the leading edge continues its run at the service closing speed, v1, and below which the leading edge slows down to a closing speed, v2<v1, as illustrated in FIG. 12(*b*).

According to another embodiment of the present invention indicated in FIG. 3 and illustrated with the dashed lines in FIG. 12(*b*), in case the proportion, P≤Ps, i.e., a detected body is considered as an accidental obstacle, after instantly stopping the movement of the leading edge in the first direction (α), the CPU is programmed to reverse said movement into the second direction (β) until the leading edge reaches a waiting position, Xw, where it stops for a waiting time, tw, before resuming its movement in the first direction (α) as long as no body is detected by the detection cells. The waiting position can be defined as a fixed position along the longitudinal axis, X1, or, alternatively, can vary with the position of impact, such as $Xw=X_{stop}+\Delta Xw$, wherein $X_{stop}$ is the position where the leading edge stopped, and ΔXw is a clearance distance. If the cell detectors fail to identify the presence of the body, as illustrated in FIG. 12(*b*) with the shaded and crossed out figure, who simply walked out of the door, the leading edge continues its run until it reaches the distal transverse edge (as shown in FIG. 12(*a*)). On the other hand, if after instantly stopping N times the movement of the leading edge in the first direction (α), because the identified body is still detected at its original location, the CPU is programmed to reverse said movement into the second direction (β), until the leading edge reaches the proximal transverse edge and stops there in an open position, as shown in the lower boxes of the flow chart of FIG. 3. The number, N, of repetitions before the shutter opens definitely is preferably comprised between 2 and 5 times.

The value of the predefined safety distance, Δxs, depends very much on the service closing speed, v1, of the shutter, as it determines the time required for stopping the leading edge before impact. The safety distance can therefore be defined as, $\Delta xs=v1\cdot t_{imp}$, wherein $t_{imp}$ is a safety impact time required for the leading edge to cover the distance, Δxs, at the service closing speed, v1. To be on the safe side, $t_{imp}$ is preferably comprised between 0.5 and 3 s, preferably, between 0.8 and 2 s. Service closing speeds, v1, comprised between 0.25 and 1 m/s, preferably between 0.5 and 0.8 m/s, are representative of fast doors. With a service closing speed of 0.75 m/s, and a safety impact time of the order of 1 s, yields a safety distance, Δxs=0.75×1=0.75 m, whilst with a service closing speed of 0.5 m/s, and a safety impact time of the order of 0.8 s, yields a safety distance, Δxs=0.5×0.8=0.4 m.

Figure 11:
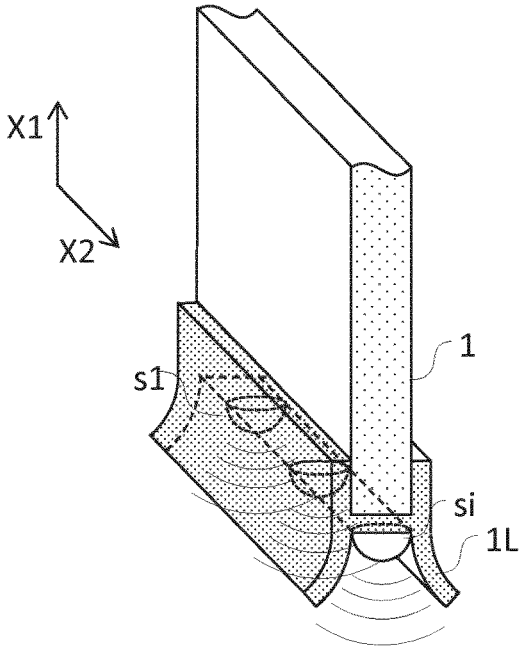
FIG. 11: shows an example according to the present invention of a leading edge provided with an array of detection cells and with resilient lips.

The detection cells (si) are preferably selected among one or more of the following: ultrasonic sensors, optical sensors, capacitor sensors, radar sensors, radio-frequency sensors, and the like. As illustrated in FIG. 11, the leading edge of the shutter is preferably provided with resilient lips with locations for the fixing of the detection cells (si). Such resilient lips have multiple advantages. First they absorb part of the impact force in case an impact between the leading edge and a body should happen. Second they protect the detection cells when the leading edge contacts the distal transverse edge. Third, they focus the radiation emitted by the detection cells to a more specific area. As illustrated in FIG. 11, the resilient lips can be formed by a first and second lips extending parallel to one another along the transverse direction, X2. Partition wall coupling one lip with the other (not shown in FIG. 11) can be provided to (a) stiffen the resilient lip structure, and (b) to further focus the radiation emitted by the detection cells in all directions.

FIGS. 4 to 8 show different situations managed by a motorized door according to the present invention. In these examples, a shutter comprising an array of n=11 detection cells (s1-s11) is illustrated, with a preset value of the safety proportion set at 80%, Ps=80%. In FIGS. 4(*a*) to 8(*a*) are represented the same motorized door with different bodies identified by the detection cells (s1-s11). In FIGS. 4(*b*) to 8(*b*) are represented the distances, Δxi, separating each detection cell (si) from the identified body. The safety distance, Δxs, is illustrated with a horizontal dashed line in the graphs (b) of FIGS. 4 to 8. The value of P=n1/11 of detection cells identifying the presence of a body at a same time located at a distance, Δx≤Δxs, is indicated in each Figure.

In FIG. 4, all the detection cells identified a body located at a distance, Δx≤Δxs=constant. With a proportion, P=100%, of detection cells identifying the presence of a body at a same time located at a distance, Δx≤Δxs, the CPU concludes that no accidental obstacle was detected by the detection cells (si), and that the detected body can only be the distal transverse edge. Consequently, as illustrated in FIG. 12(*a*), the CPU orders the command system to reduce the closing speed until the leading edge (1L) contacts the distal transverse edge (20D).

In FIG. 5, a car is parked through the door. The detection cells have identified the presence of the car but it is still remote from the leading edge, with no detection cell identifying a distance Δx≤Δxs. Two detection cells, s8 and s9, however, are located closer than the precautionary distance, x8&x9≤Δxp. According to a preferred embodiment of the present invention, the CPU may therefore order the command system to reduce the closing speed from v1 to v2<v1, as shown with the solid line in FIG. 12(*b*).

In FIG. 6, the leading edge keeps moving in the first direction (α) getting closer to the car which has not moved. Three detection cells now identify the presence of the car at a distance Δx≤Δxs. The proportion, P=3/11=27% is smaller than the safety proportion, Ps=80%. The CPU therefore considers the detected car as an accidental obstacle and stops the movement of the leading edge. In case, as illustrated in FIG. 12(*b*), the leading edge was moving at a reduced closing speed, v2, the stopping of the leading edge can be completed very rapidly.

In FIG. 7 the trailer of a truck is parked across the door. The flat platform of the trailer forms a raised deck occupying almost the whole width (in the transverse direction, X2) of the door opening. All the detection cells si, but s1 and s11, detected the presence of the platform at a distance Δx≤Δxs. The proportion, P=9/11=82%, which is higher than the safety proportion, Ps=80%. Consequently, the CPU considers the raised platform as a distal transverse edge (20D) and orders the command control to reduce the speed until the leading edge contacts the platform, as illustrated in FIG. 12(*a*).

FIG. 8 is quite similar to FIG. 6, but the detected body is a human body, with more serious consequences in case of impact with the leading edge. Two detection cells only, s6&s7, detected the presence of the human body located at a distance Δx≤Δxs. The proportion P=2/11=18%<Ps=80%. As illustrated in FIG. 12(*b*), solid line) the CPU therefore considers the detected human body as an accidental obstacle and stops the movement of the leading edge.

Unlike the motorized doors of the prior art, a motorized door according to the present invention can distinguish whether an identified body is a distal transverse edge, including a non-permanent raised deck, or an accidental obstacle, and triggers different control procedure of the closing of the shutter accordingly. With a better prediction of the possible stopping of the shutter, a smaller motor can be used. Furthermore, the detection cells can be mounted very easily on the leading edge of existing doors, and coupled to a CPU either by cable or by wave (e.g., Bluetooth). The control of the detection cells can be coupled to the existing CPU originally controlling the movements of the door. Safety and closure efficacy are both enhanced with a motorized door according to the present invention.

| REF | DESCRIPTION |
|---|---|
| 1 | shutter |
| 1B | shutter bead |
| 1L | leading edge of shutter |
| 1P | rigid panel of an articulated shutter |
| 2 | rotating drum |
| 4 | guiding rails |
| 5 | motor |
| 20 | area to be closed and opened |
| 20D | distal transverse edge of area |
| 20L | first and second longitudinal edges of area |
| 20P | proximal transverse edge of area |
| 30 | wall surrounding the area |
| α | first direction of leading edge displacement to close the area |

-continued

| REF | DESCRIPTION |
|---|---|
| β | second direction of leading edge displacement to open the area |
| CPU | processing unit |
| n | number of detection cells at the leading edge |
| n1 | number of detection cells having detected an object |
| P | proportion, n1/n, of detection cells having detected an object |
| Ps | safety proportion |
| s1, . . . sn | detection cells 1 to n |
| $t_{imp}$ | safety impact time, $t_{imp}$ = Δxs/v1 |
| tw | waiting time at Xw before closing the door again |
| v1 | service closing speed |
| v2 | reduced closing speed |
| X1 | longitudinal axis |
| X2 | transverse axis, normal to X1 |
| x1 | instant distance of the leading edge from the distal transverse edge 20D |
| x1,0 | position of leading edge when the area is closed by shutter |
| x1.1 | position of leading edge when the area is open |
| Xstop | stop position of the leading edge |
| Xw | waiting position after reversing the door movement |
| Δx | actual distance between a detection cell and a body measured along X1 |
| Δxp | precautionary distance between a detection cell and a body measured along X1 |
| Δxs | safety distance between a detection cell and a body measured along X1 |
| ΔXw | clearance distance from stop position |

The invention claimed is:

1. A motorized door for closing an area, said area being defined by a first and second lateral edges which extend parallel to a longitudinal axis, X1, by a proximal transverse edge extending parallel to a transverse axis, X2, normal to the longitudinal axis, X1, and a distal transverse edge, transverse to the longitudinal axis, X1, wherein said motorized door comprises:

(A) a shutter sized to close the area, and comprising a leading edge substantially parallel to the distal transverse edge of the area, (B) a motorized driving mechanism configured to move the leading edge of the shutter along the longitudinal axis, X1, between an open position, wherein the leading edge is adjacent to the proximal transverse edge and a closed position, wherein the leading edge contacts the distal transverse edge, in a first direction to close said area and in a second direction to open said area;

(C) an array of n detection cells (s1, s2, . . . , sn), wherein n≥2, distributed along the leading edge of the shutter, each respective detection cell of said array of n detection cells being adapted to detect and communicate to a processing unit (CPU) a presence of a body and a distance, Δx, from said respective detection cell measured along the longitudinal axis, X1, to the body positioned between said respective detection cell and the distal transverse edge, (D) the processing unit (CPU) programmed to receive signals from each of the n detection cells and to trigger the following operations, in case a number n1 of the array of n detection cells, with n1≥1, communicates to the CPU the detection of the presence of the body located at a distance, Δx, of less than or equal to a predefined safety distance, Δxs, from said detection cell, Δx<Δxs, during the moving in the first direction of the shutter at a service closing speed, v1, from the open position towards the closed position, (a) in case a proportion, P=n1/n, of respective detection cells of the array of n detection cells identifying the presence of the body at a same time located at the distance, $\Delta x \leq \Delta xs$, is less than or equal to a predefined safety proportion, Ps, ($P \leq Ps$) the CPU is programmed to instantly stop the movement of the leading edge in the first direction, and optionally reverse said movement into the second direction;

(b) in case the proportion, P, of respective detection cells of the array of n detection cells identifying the presence of the body at the same time located at the distance, $\Delta x \leq \Delta xs$, is greater than the safety proportion, Ps, ($P > Ps$), the CPU is programmed to communicate a signal to progressively reduce the closing speed of the leading edge in the first direction, down to a stop upon contacting said body at $\Delta x = 0$.

2. The motorized door according to claim 1, wherein the safety proportion, Ps, is from about 80% to about 100%.

3. The motorized door according to claim 1, wherein the array of n detection cells distributed along the leading edge of the shutter comprises at least 3 detection cells per metre of leading edge measured along the transverse direction, X2.

4. The motorized door according to claim 1, wherein the detection cells are selected among one or more of the following: ultrasonic sensors, optical sensors, capacitor sensors, radar sensors, and radio-frequency sensors.

5. The motorized door according to claim 1, wherein in case $P \leq Ps$, and all of the n1 detection cells of the array of n detection cells having detected the presence of the body communicate to the CPU that said body is located at a distance, $\Delta x$, greater than the predefined safety distance, $\Delta xs$, from each of said detection cells, $\Delta x > \Delta xs$, during the moving in the first direction of the shutter at the service closing speed, v1, from the open position towards the closed position, the CPU is programmed to trigger the following operations:

(a) in case the distance, $\Delta x$ greater than the predefined safety distance, $\Delta xs$, is greater than a precautionary distance, $\Delta xp$, which is predefined, keep closing the door at the service closing speed, v1, (b) in case the distance, $\Delta x$ greater than the predefined safety distance, $\Delta xs$, is not greater than the precautionary distance, $\Delta xp$, reducing the closing speed to a reduced closing speed, v2<v1.

6. The motorized door according to claim 1, wherein the service closing speed, v1, is from about 0.25 to about 1 m/s.

7. The motorized door according to claim 5, wherein the reduced closing speed, v2, is from about 40% to about 80% of v1.

8. The motorized door according to claim 1, wherein the safety distance, $\Delta xs = v1 \cdot t_{imp}$, wherein $t_{imp}$ is a safety impact time required for the leading edge to cover the distance, $\Delta xs$, at the service closing speed, v1, and wherein $t_{imp}$ is from about 0.5 to about 3 s.

9. The motorized door according to claim 1, wherein in case the proportion, $P \leq Ps$, as defined in claim 1 (a), after instantly stopping the movement of the leading edge in the first direction, the CPU is programmed to reverse said movement into the second direction until the leading edge reaches a waiting position, Xw, where it stops for a waiting time, tw, before resuming its movement in the first direction as long as no body is detected by the detection cells.

10. The motorized door according to claim 9, wherein after instantly stopping N times the movement of the leading edge in the first direction, the CPU is programmed to reverse said movement into the second direction until the leading edge reaches the open position, wherein N is from 2 to 5 times.

* * * * *